US005941275A

United States Patent [19]

Laing

[11] Patent Number: 5,941,275

[45] Date of Patent: Aug. 24, 1999

[54] PUMP FOR PERIODIC CONVEYANCE OF THE COOLED-DOWN WATER CONTENT OF A HOT WATER DISTRIBUTION LINE

[76] Inventor: Karsten Andreas Laing, Erzgebirgeweg 39, 70736 Fellbach, Germany

[21] Appl. No.: 08/669,147

[22] Filed: Jun. 24, 1996

[30] Foreign Application Priority Data

Jun. 26, 1995 [DE] Germany ..... 195 23 045

[51] Int. Cl.[6] ..... F24H 1/00

[52] U.S. Cl. ..... 137/337; 137/563; 126/362; 417/12

[58] Field of Search ..... 126/362; 137/337, 137/563; 417/12

[56] References Cited

U.S. PATENT DOCUMENTS 5,009,572 4/1991 Imhoff et al. ..... 417/32

5,143,049 9/1992 Laing et al. ..... 126/362

5,277,219 1/1994 Lund ..... 137/337

*Primary Examiner*—A. Michael Chambers

*Attorney, Agent, or Firm*—Henri J. A. Charmasson; John D. Buchaca

[57] ABSTRACT

A hot water distribution system incorporating a pump positioned close to, and between each set of hot and cold water taps to which periodically move the cooled-down water content of the hot water distribution line through the cold water distribution line back to the hot water tank until the total content of the hot water line has a predetermined temperature. The pump is provided with a valve responsive to pump-generated pressure to prevent backflow when the pump is not in use and the pressure in the cold water distribution line is lower than the pressure in the hot water distribution line, such as when water is drawn through a cold water tap.

12 Claims, 2 Drawing Sheets

PUMP FOR PERIODIC CONVEYANCE OF THE COOLED-DOWN WATER CONTENT OF A HOT WATER DISTRIBUTION LINE

FIELD OF THE INVENTION

The invention relates to a hot water distribution system incorporating a pump which moves the cooled-down water content of the hot water distribution line back to the hot water tank.

PRIOR ART

Hot water recovery systems exist as described in U.S. Pat. No. 5,277,219, in which a pump 46 is switched on by detector 64 as soon as a hot water faucet is opened. To economize the hot water usage the pump 46 conveys the cooled-down content of the hot water distribution line back through the cold water distribution line into the hot water tank. This results in almost immediate warm water at a tap 40 close to the warm water tank; however the next faucets in the line only receive warm water when the cooled-down water content between the first faucet and the second faucet is expelled. This amount of water is lost. Other circulating systems are known in which the water content of the hot water circulation line is conveyed back into the hot water tank via a recirculation pipe. Subsequent retrofit of a recirculation system requires substantial additional piping costs, and the addition of an inlet port in the lower region of the hot water tank.

The present invention avoids these drawbacks.

SUMMARY OF THE INVENTION

Object of the invention is a recirculation system which conveys the cooled-down content of the hot water distribution line back to the hot water tank via the cold water distribution line.

The system consists of a pump whose inlet port is connected to the end portion of the hot water distribution line, and whose pressure side of the impeller communicates with a space which in turn communicates via a check valve with the cold water distribution line as soon as the pump is switched on. The check valve prevents flow of cold water from the cold water distribution line into the hot water distribution line. Said space contains a second valve which prevents opposite flow of warm water into the cold water distribution line when a cold water faucet is opened, causing a pressure drop at the end of the cold water distribution line. This second valve is designed in such a way that it closes the connection between said space and the check valve when the pump is shut off, and that it opens through the pressure of the impeller which builds up when the pump starts. In this case the water conveyed by the pump flows through the check valve into the cold water distribution line. The active part of the second valve is formed by the inner or central portion of a rubber membrane, one side of which faces the suction side of the pump impeller, while the inner portion of the other side performs the inhibiting function of the valve. The outer portion of said membrane faces said space which communicates with the pressure side of the impeller. As soon as the water arriving at the pump reaches a predetermined temperature, a thermo-switch turns off the pump until the temperature drops to a predetermined lower temperature, at which moment the cycle starts anew. Instead of a thermo-switch for the hot water temperature, a thermo-switch can be used which shuts off the pump at a lower, predetermined temperature indicating that water with the hot water temperature has filled the hot water distribution line over almost its whole length. Such an installation prevents hot water from entering the cold water distribution line.

In systems in which the temperature increase in the cold water distribution line is undesirable, the water is conveyed through a vessel with a large outer surface having approximately the same volume as the hot water distribution line. Instead of a vessel with cooling fins a coil can be used which has the advantage that a mixture between warm water and cooled-down water is avoided.

It is also possible to replace the thermo-switch by a manual switch.

DETAILED DESCRIPTION OF THE DRAWINGS

Figure 1:
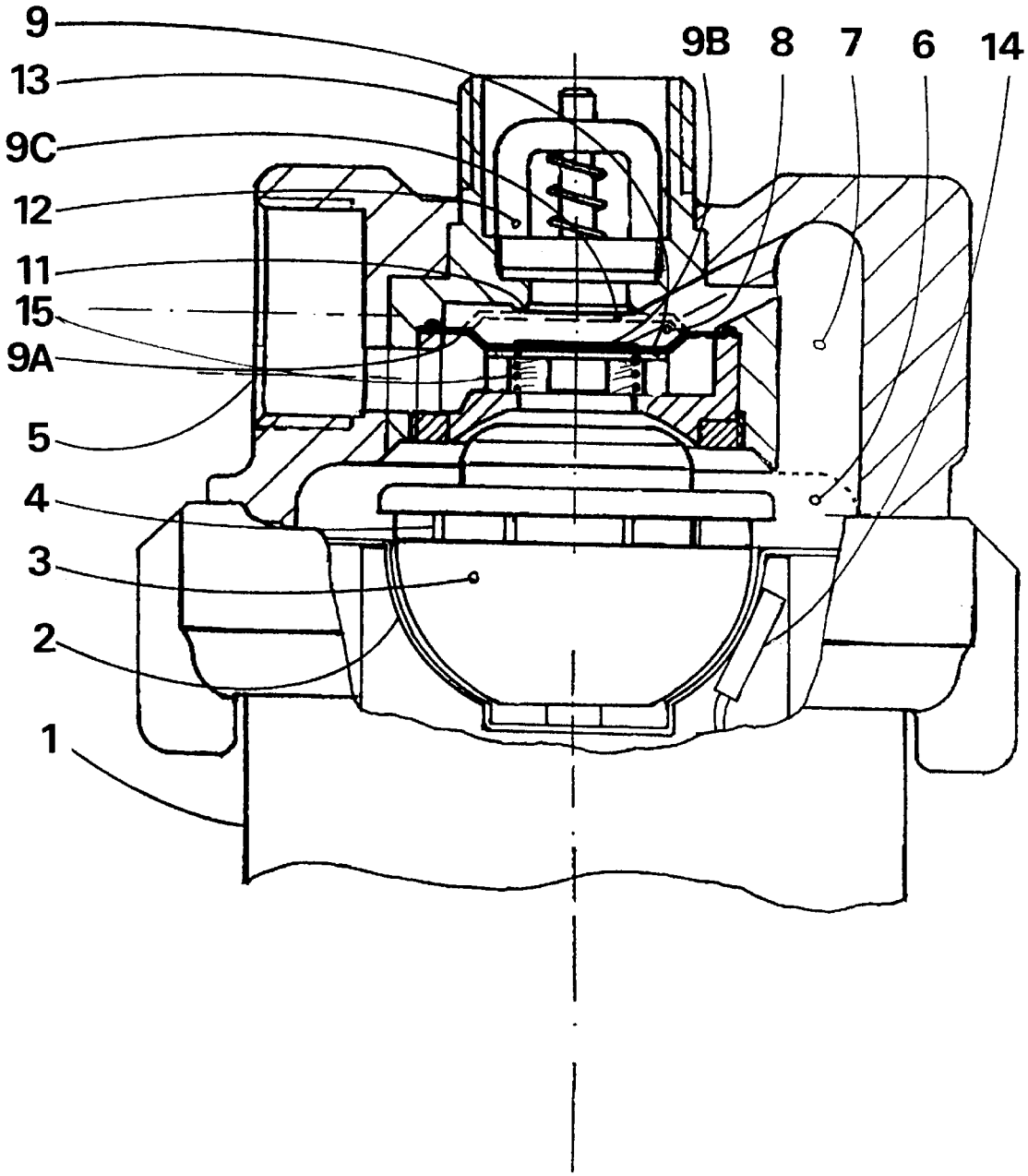
FIG. 1 shows a schematic presentation of the pump-valve-unit.
Figure 2:
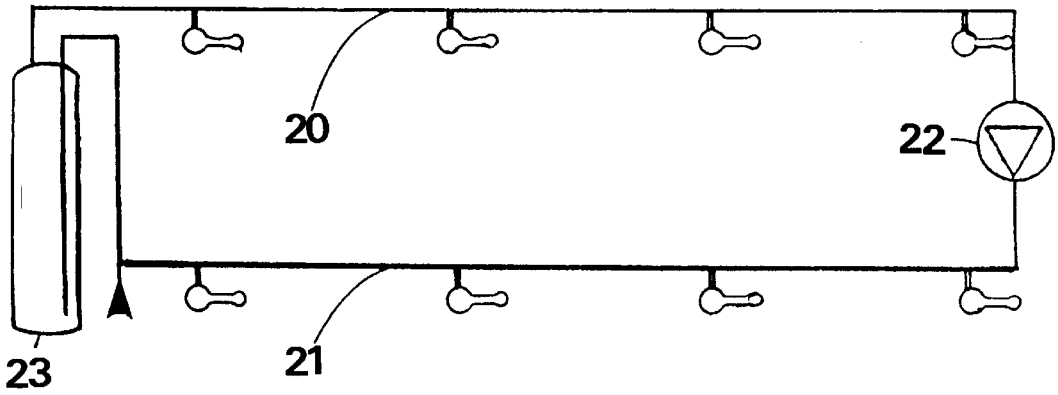
FIG. 2 shows the diagram of a water distribution system.

FIG. 1 shows a circulation unit. Stator 1 which creates a rotating magnetic field is separated from the water by a magnetically permeable separation wall 2. A spherical rotor 3 forms a rotating unit with the pump impeller 4. Inlet port 5 of the pump housing communicates with the hot water distribution line 20 as illustrated in FIG. 2. The impeller 4 transports the cooled-down water in the hot water distribution line 20 into the spiral housing 6. From there the water runs through the end portion 7 of the spiral housing into space 8, whose wall on the opposite side from the spiral housing is formed by an elastic membrane 9, resiliently biased toward the valve seat 11 by a spring 15. If the pump exerts pressure on the outer annular region 9A of membrane 9, which surrounds the central valve region 9B and is never in contact with the valve seat 11. The membrane 9 moves from the dotted line position 9C into the solid line position 9A, whereby the central valve region 9B will lift from valve seat 11. At the same time the pump pressure opens check valve 12, so that the cooled-down content of the hot water distribution line 20 can be conveyed through port 13 of the pump housing into the cold water distribution line 21. The thermo switch 14 is in good heat conducting contact with the separation wall 2. This thermo switch 14 switches off the pump 1,2,3,4 as soon as a predetermined water temperature has been reached at the end of the hot water distribution line 20. It might be advantageous if the switch 14 were to switch off the pump when a predetermined temperature, considerably lower than the final hot water temperature, is reached, indicating that the hot water is not far from the end of the hot water distribution line 20.

Since each opening of a faucet creates a pressure drop in either water distribution line 20 or 21, water from the distribution line with closed faucets would flow into the pipe with an open faucet. To avoid this, check valve 12 prevents cold water from entering the hot water distribution line 20, and valve region 9B of membrane 9 prevents hot water from entering the cold water distribution line 21.

FIG. 2 shows pump 22 inserted between the two distribution lines 20 and 21. The hot water distribution line 20 is connected with the outlet port of the hot water tank 23, and the cold water distribution line 21 is connected with its inlet port.

In some cases, the relatively minor temperature increase in the cold water distribution line, which results from the escape of cooled-down water into the cold water distribution line, cannot be tolerated. In such cases, a heat exchanger with large superficial area, such as a coil, with a volume which is similar to the volume of the hot water distribution line will be inserted between the outlet port 13 and the cold water distribution line 21. During the cool-down period of the hot water in the hot water distribution line, the heat exchanger dissipates so much heat that the temperature of the cooled-down water conveyed into distribution line 21 when the next pump cycle starts, will present no problem.

Figure 3:
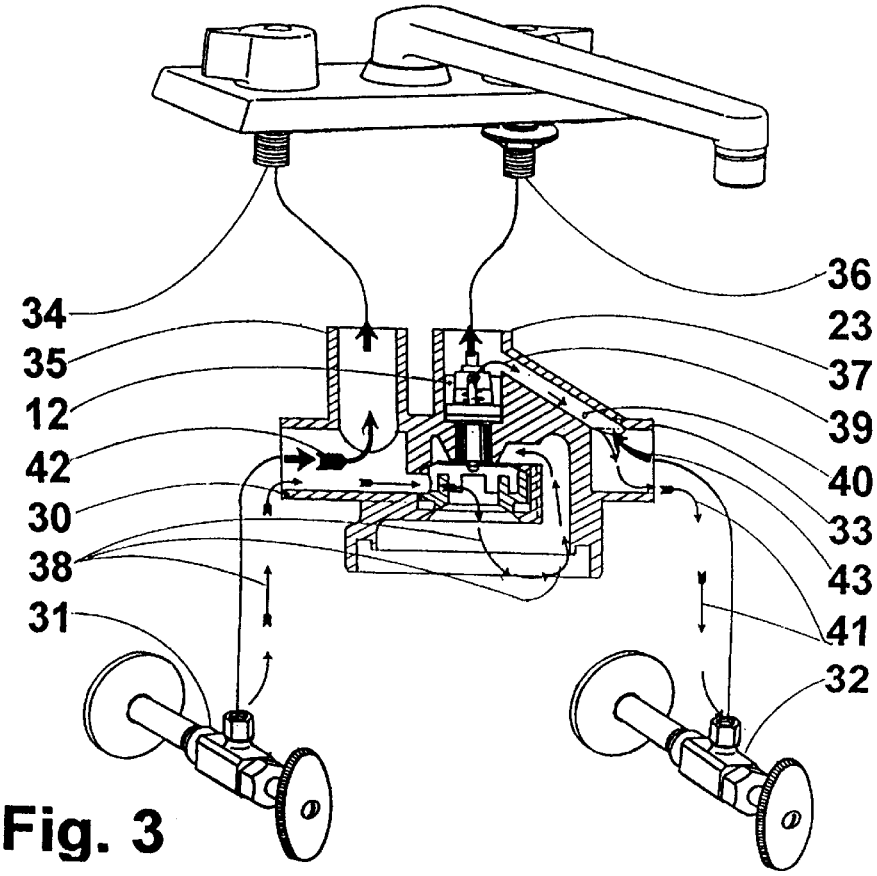
FIG. 3 shows a special pump housing to be inserted between the shutoff valves and the faucets.

FIG. 3 shows a pump housing with four ports, which can be installed under a sink at the end of the hot water distribution line 20. Port 30 is connected to a shutoff valve 31 in the hot water distribution line 20. Shutoff valve 32 of the cold water distribution line 21 is connected to port 33, the hot water faucet valve 34 is connected to port 35, faucet valve 36 is connected to outlet port 37. If the water temperature in the hot water distribution line 20 drops to a predetermined level, thermo switch 14 activates the pump which extracts the cooled-down-water content of the hot water distribution line 20 and propels it in the direction of arrows 38 through check valve 12. Thence the water travels according to arrow 39 through channel 40, outlet port 33, and according to arrows 41 to cold water shut-off valve 32. From there the water runs through the cold water distribution line 21 back into the hot water tank 23. As soon as hot water reaches the pump 1,2,3,4, the thermo switch 14 shuts off the pump. When valve 34 is opened, hot water runs according to arrows 42 from the hot water shut-off valve 31 to the hot water faucet valve 34. When the cold water faucet valve 36 is opened, cold water flows according to arrows 43 through outlet port 37 to faucet valve 36. Flow according to arrows 38 and 41 does not interfere with flow according to arrows 42 and 43.

I claim:

1. A pump which comprises:

a suction region, a pressure region, and an impeller for moving a liquid from said suction region to said pressure region;

an inlet port leading to said suction region an outlet port leading from said pressure region a back flow inhibiting first valve located between said pressure region and said outlet port;

a differential pressure-controlled second valve located within said pressure region;

said second valve including an opening control mechanism responsive to the pressure of the inlet port exceeding the pressure of the outlet port.

2. The pump of claim 1, wherein the second valve opens under said moving of liquid by the impeller.

3. The pump of claim 2, wherein said pressure region comprises a first chamber having an outlet port controlled by said first valve, and an inlet port controlled by said second valve;

said inlet port comprises an annular valve seat;

said second valve comprises a closure member having a distal face, said distal face including a central portion shaped, dimensioned, positioned and resiliently biased to close said inlet port, and a peripheral portion surrounding said central portion, said peripheral portion being exposed at all times to any of said liquid moved by said impeller.

4. The pump of claim 3, wherein:

said closure member comprises a spring biasing a central portion of said membrane toward said annular valve seat;

said pressure region comprises a second chamber including an annular region surrounding said annular valve seat; and said annular region is partially delineated by said peripheral portion;

whereby when said water is moved by said impeller, it applies pressure over said peripheral portion.

5. A hot and cold water distribution system wherein hot water is distally delivered through a hot water line from a water heater to a hot water faucet, and cold water is delivered through a cold water line to said water heater and to a cold water faucet proximate to said hot water faucet, said system comprising the pump of claim 2 installed proximate said faucet to draw cooled water out of said hot water line and back into said cold water line.

6. The system of claim 5 which further comprises a thermal sensor in contact with a water-conveying part of said pump; and means responsive to said thermal sensor to control the movement of said impeller.

7. The system of claim 5 which further comprises a cooling vessel interposed between the outlet of said pump and the cold water line.

8. In a centrifugal pump, where a rotating impeller is driven to cause a fluid to flow from an inlet region to an outlet region, an improvement for preventing backflow through said pump when the impeller is not driven, said improvement comprising valve means between said impeller and said outlet region, said valve means being positioned and oriented to only open in response to fluid pressure generated when said impeller is driven;

wherein said valve means comprise:

a chamber having a translatable wall section, and an escape aperture into said outlet region, said aperture being surrounded by a valve seat;

said translatable wall section having a first portion shaped and dimensioned to close said aperture in a first position and to allow flow of fluid through said aperture in a second position;

means for resiliently biasing said first portion toward said first position; and said translatable wall section further having a second portion shaped and positioned to avoid contact with said valve seat and aperture in either one of said first and second positions.

9. The improvement of claim 8, herein said translatable wall section comprises a membrane having a central area defining said first portion and a peripheral area defining said second portion; and said means for resiliently biasing comprises a spring.

10. The improvement of claim 8, wherein said translatable wall section has an outer side area exposed to said inlet region.

11. The system of claim 8 which further comprises a thermal sensor in contact with a water-conveying part of said pump; and means responsive to said thermal sensor to control the movement of said impeller.

12. The system of claim 11 which further comprises a cooling vessel interposed between the outlet of said pump and the cold water line.

* * * * *